United States Patent [19]

Willingham

[11] 4,257,554

[45] Mar. 24, 1981

[54] FAN ASSEMBLY

[75] Inventor: Rainer O. Willingham, Tacoma, Wash.

[73] Assignee: Flex-A-Lite Products Corporation, Tacoma, Wash.

[21] Appl. No.: 962,136

[22] Filed: Nov. 20, 1978

[51] Int. Cl.[3] ..... F01P 7/02

[52] U.S. Cl. ..... 236/35; 123/41.12; 165/122; 248/674

[58] Field of Search ..... 236/35; 123/41.49, 41.48, 123/41.46, 41.11, 41.12; 62/507; 165/122; 248/674, 232, 233

[56] References Cited

U.S. PATENT DOCUMENTS

| | | | |
|---|---|---|---|
| 1,849,946 | 3/1932 | Modine | 165/122 |
| 1,870,378 | 8/1932 | Noblitt et al. | 248/232 X |
| 1,899,099 | 2/1933 | Mack | 165/122 X |
| 1,900,586 | 3/1933 | Rippe | 123/41.12 X |
| 1,975,066 | 9/1934 | Sanderson | 165/122 X |
| 1,992,795 | 2/1935 | Young | 165/122 |
| 2,265,054 | 12/1941 | Baker | 62/507 |
| 2,330,653 | 9/1943 | Wilson | 165/122 |
| 2,594,688 | 4/1952 | Shapiro | 248/674 X |
| 3,093,189 | 6/1963 | Panthofer | 165/122 X |
| 3,394,682 | 7/1968 | Bensinger | 123/41.12 |

*Primary Examiner*—William E. Tapolcai, Jr.
*Attorney, Agent, or Firm*—Thomas W. Secrest

[57] ABSTRACT

This invention is directed to a fan assembly for use with temperature exchange units and heat exchange units such as a radiator, a heater, an oil cooler, etc. Most automotive vehicles are powered by an internal combustion engine having water, oil and other fluids to be cooled. And, most of the internal combustion engines are associated with a radiator or a heat exchanger unit for cooling fluid in the engine, transmission or other oils and hydraulic fluids. An automotive vehicle operating at a low speed usually requires a fan to assist the radiator or heat exchanger unit in cooling the cooling fluids. However, at higher ram air speed a fan is not normally required to assist the radiator or heat exchanger in cooling the cooling fluids as there is sufficient cooling due to the natural passage of air over the cooling surfaces of the heat exchange units. This invention is directed to a fan assembly which can be used in vehicles having a requirement to dissipate excess heat and a radiator or heat exchanger unit with which a fan assembly can be operated when the automotive vehicle is traveling at a low speed and which fan assembly ceases to operate when the automotive vehicle fluids are sufficiently cooled at a relatively high speed.

6 Claims, 8 Drawing Figures

FAN ASSEMBLY

THE BACKGROUND OF THE INVENTION

Automotive vehicles are, normally, powered by internal combustion engines. The internal combustion engine maybe gasoline, diesel or liquefied petroleum gas. Also, there is, normally, associated with the internal combustion engine a radiator and other heat exchangers for receiving a hot fluid such as hot liquid water or water mixed fluids from the internal combustion engine, or oils from other components. The internal combustion engine has a crank shaft and there is a fan mounted on the engine and which fan receives power from the crank shaft. The fan assists in the flow of air passing through the radiator for cooling the cooling fluid or cooling water in the radiator and attached heat exchangers before returning the cooling fluid or cooling water to the internal combustion engine or other components.

There are some internal combustion engines that are air cooled such as an air cooled diesel engine, air cooled gasoline engine and air cooled liquefied petroleum gas engine. The percentage of internal combustion engines which are air cooled is a small percentage. However, other vehicle systems or components may require temperature exchange units to which this invention would apply.

An automotive vehicle which has an internal combustion engine and a radiator and a fan normally requires the use of a fan at low speeds, viz., 25 miles per hour or less to provide sufficient cooling airflow. At these low speeds there is not enough airflow to cool the cooling fluid or cooling water in the radiator or attached heat exchangers. Therefore, a fan is required to cool the cooling fluid or cooling water.

At highway speeds there is normally sufficient airflow passing through the radiator or attached heat exchangers to cool the cooling fluid or cooling water and there is no need to have a fan for auxiliary cooling purposes. In most automotive vehicles when the crank shaft rotates the fan rotates. At low speeds this is necessary. At speeds greater than 25 miles per hour normally the rotation of the fan is a needless waste of energy. Even though the fan is not required for cooling purposes for an automobile operating above 25 miles per hour, the fan when attached to the crank shaft still rotates at these higher speeds and requires energy for rotation which usually results in a waste of energy and fuel.

In the past few years there has been a desire to lessen the waste of energy due to the rotation of the fan. For example, there have been brought forth flexible blade fans and which flexible blades may be made of plastic or stainless steel. The blades are in a normally curved position. At a rest condition the blades of the fan are curved. This is so that there is greater airflow induced by the rotation of the fan at lower speeds. At speeds above 25 miles per hour the blades tend to flatten and are not as curved, thereby decreasing the amount of resistance due to the rotation of the blades. Remember, at speeds greater than 25 miles per hour, it is not necessary to have a fan for cooling the fluid in the radiator. At the higher speeds and with the flexible blade fans the blades have flattened and there is less resistance to the rotation of the blades and therefore less use of energy and less waste of energy on the part of the rotating fan and on the engine that is causing the fan to rotate.

Clutches and declutching devices to which fan blades are attached are similarly employed, however, are expensive, heavier, prone to fail, and require more energy to function.

There are air conditioning condenser, oil cooler, transmission oil cooler, hydraulic oil cooler, heaters, air conditioners and other devices that rely on air movement to exchange temperatures. This device is able to be mounted directly to those temperature dissipation surfaces and permits remote location of such devices because they do not have to rely on ram air or engine driven fans for temperature exchanging airflow.

A BRIEF DESCRIPTION OF THE INVENTION

This invention is explained, using the example of an electric fan assembly which can be installed on a radiator or other temperature exchanging device, and in a position to assist the cooling of the cooling fluid in such device (other power sources and engaging systems may be employed). In this example, there is a temperature sensor placed with respect to the device to detect the temperature of the cooling fluid or cooling water associated with the engine or other component and the temperature exchanging device. At low speeds, normally, there is not sufficient cooling of this cooling fluid and the adjustable sensor switch unit detects the temperature of the cooling fluid and signals for the motor to operate and the fan to rotate to assist in cooling the cooling fluid in the temperature exchange device.

At higher speeds, normally, there is sufficient airflow through the temperature exchanging device to cool the cooling fluid. Again, the adjustable sensor switch senses the temperature of the cooling fluid and determines that the cooling fluid is of a sufficiently low temperature and signals the motor to stop operating and the fan ceases to rotate. The sensor switch signals directions to the motor in response to the temperature of the cooling fluid and the motor operates or does not operate as a result of these signals.

It is possible to have manual control of the motor so as to operate the motor at the direction of the operator and to have the fan rotate and assist in cooling the cooling fluid in the radiator, independent of the switch sensor.

A radiator or heat exchanger is normally composed of a top and a bottom tank or side tanks in cross flow, joined by tubes for fluid passage and for fluid temperature transfer. Such tubes are further joined by a network of very thin parallel metal fins extending beyond and which further transfers heat via air passage to the atmosphere. A combination of pressure plus temperature variables with differentials (internal and external, lateral and vertical), further combined with vehicle vibrations and contacts with foreign object tend to sever, separate and break the fluid seals between tubes and radiator tanks. As noted in FIGS. 2 and 3, the unique mounting bracket and pad combination of this invention are of such a size and radius to cover a multiple of fins with a multi-directional and bracing type stability. As such, the fins, which are individually fragile, combine with the fan assembly in the stronger parallel profile to form a unique unitized structural monocoque. Any individual fin and tube weakness or stress in any direction is offset manyfold by a collective strength in combination with the fan assembly. Laboratory evaluations, more strenuous than in actual use, confirm that this new technique not only properly supports the depicted assembly in its operation but, conservatively, doubles the structural integrity of the overall radiator.

This invention is also applicable to hot or cold temperature exchange units not associated with ram air effects or the internal combustion engine. As this invention allows the flexibility for remote locations of said temperature exchange units not relying on ram air or belt driven fans to provide temperature exchanging airflow. This remote location feature further permits improvements in vehicle design to take advantage of both limited and otherwise available spacing, plus improves cooling efficiency through reduced stacking of a multi-purpose combination of heat exchanger devices.

Additionally, this invention relates to an attachment capability of fan assembly to the heat exchanger whereby optimum heat rejection performance may be obtained; elimination of other components such as conventional fan, shroud, belt, pulley, etc. (depending on application); flexibility of locations and application such as operations in a blowing or sucking mode, a combination of both, and for augmenting conventional fan for still additional cooling, only if and as needed.

While providing for multiple or alternate power sources for fan operations and for automatic temperature sensing, continuous or manual operations and combinations thereof, the light weight and unique mounting technique of this invention further improves the structural integrity of the radiator or heat exchanger attached thereto. Cost and weight reduction is enhanced through elimination of other components; noise is reduced since fan operates at a set low RPM; the low inertia through weight reduction, design, composition and low RPM eliminates safety hazards, inherent in the conventional fan. Much energy savings is realized in both the reduced production of counterpart components and the efficiency of operation during its infinite use.

THE DRAWINGS

Figure 7:
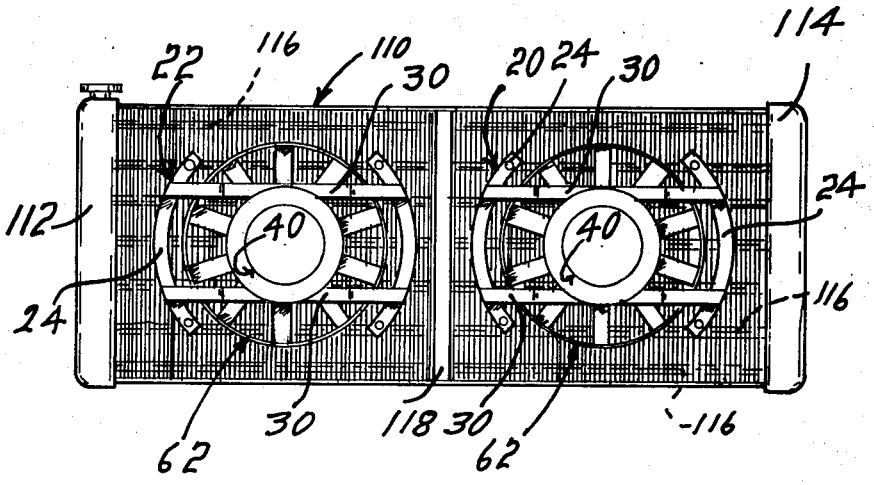
Figure 8:
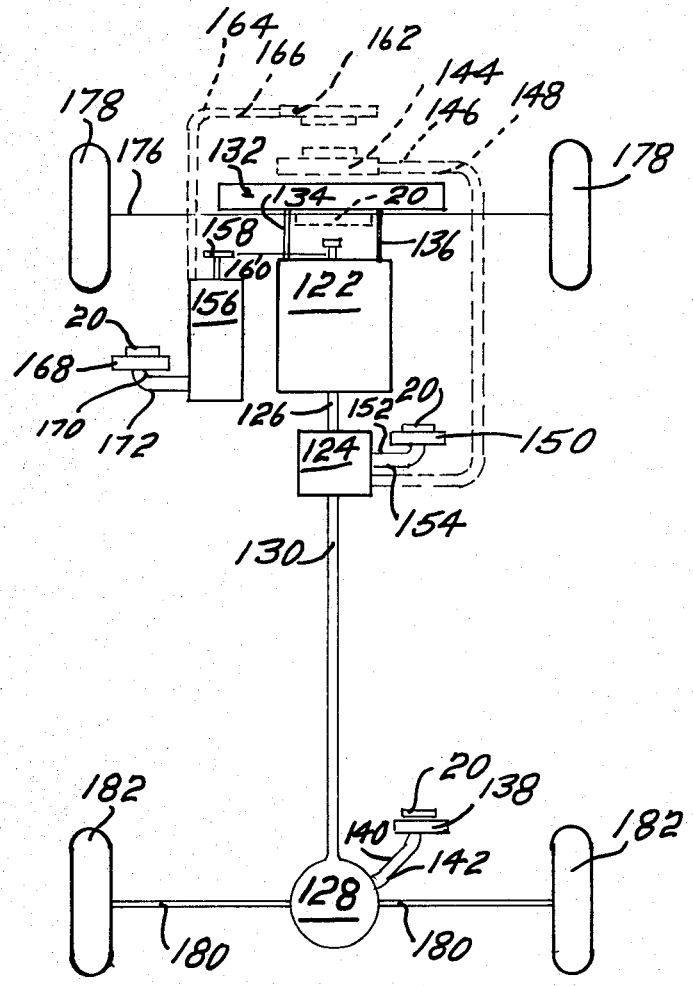

FIG. 7 is an elevational view of a wide radiator having vertical reservoirs and horizontal tubes with the fan assembly positioned on the radiator and functioning to brace and to reinforce the radiator; and, FIG. 8 is a schematic illustration of an automotive vehicle and shows heat exchangers, viz., radiators and fan assemblies, for dissipating heat energy generated in the engine, in the transmission, in the air conditioner and in the differential.

THE SPECIFIC DESCRIPTION OF THE INVENTION

Figure 1:
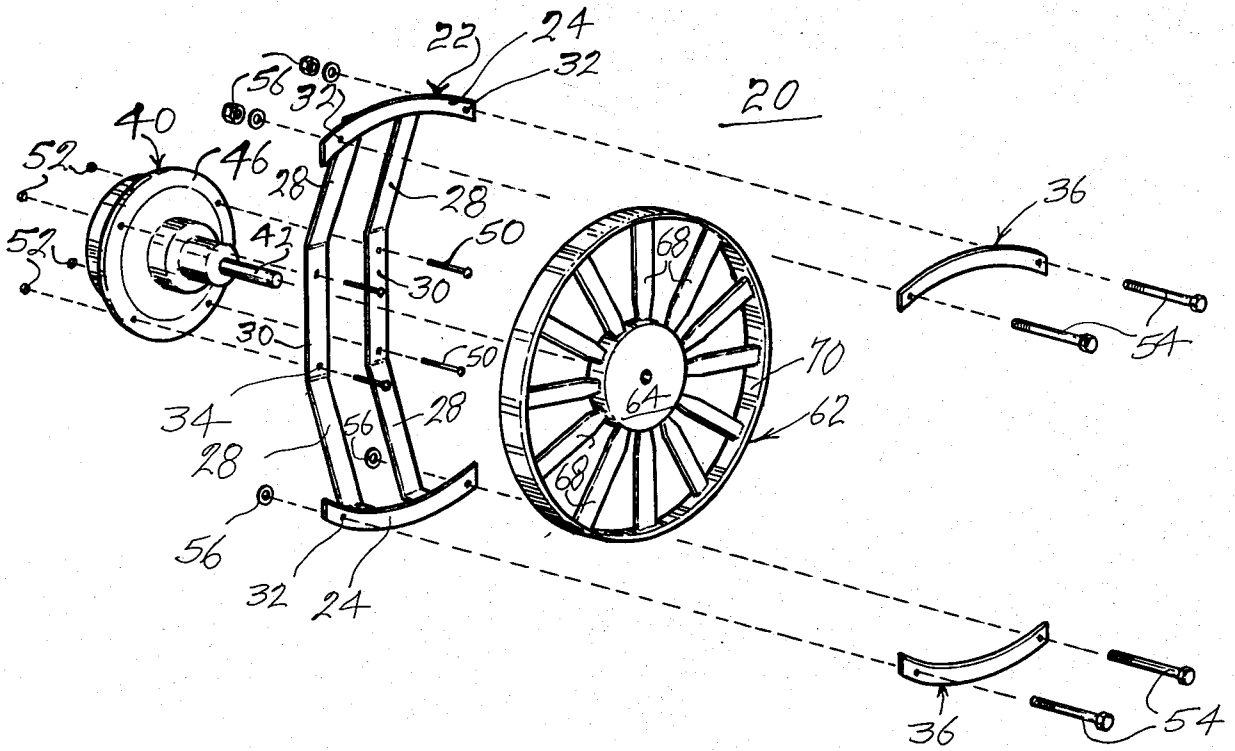
FIG. 1 is an exploded perspective view illustrating the components of the fan assembly and which components are an electric motor, a mounting bracket and a fan.

In FIG. 1 there is illustrated a fan assembly 20.

This fan assembly 20 comprises a supporting bracket 22 having two spaced apart curved bases 24 joined by two spaced apart supporting ribs 26. Each supporting rib connects with a curved base 24 by means of an angular piece 28. The two angular pieces 28 are joined by a flat piece 30.

The reader is to realize that the mounting bracket 22 may be of unitary construction and may be of plastic. Also, the mounting bracket 22 comprising the two bases 24 and the support rib 26 may be of an integral construction fabricated from metal.

At the end of each curved base 24 there is a through passageway 32. In all, there are six through passageways 32. In the central portion 30 of each support rib 26 there are two spaced apart through passageways 34. In all, there are four through passageways 34 in the mounting bracket 22.

There are two curved mounting pads 36. Each mounting pad 36 is similar to a curved base 24. In each mounting pad 36 there are three through passageways 38. The curve of the mounting pad 36 is similar to the curve of the curved base 24 and the through passageways 38 in the mounting pad 36 are similar to the through passageways 32 in the curve base 24.

There is an electric motor 40. The electric motor 40 has a rotating output shaft 42.

The electric motor 40 has a housing 46 and in the exterior circumferential portion of the housing 46 there are four through passageways 48. The spacing and pattern of the through passageways 48 are the same as for the through passageways 34 in the support 30 of the support rib 26. This makes it possible to join the electric motor 40 to the support ribs 26 by means of bolts 50 passing through the passageways 34 and the passageways 48 and by means of nuts on the bolts 50.

The curved base 24 of the mounting bracket 22 and a mounting pad 36 are united by passing a bolt 54 through a passageway 38 in the mounting pad 36 and also passing the bolt 54 through the passageway 32 in the curved base 24. Then, a nut 56 can be screwed onto the bolt 54.

There is a fan 62 having a hub 64. In the hub 64 there is a through passageway 66.

Attached to the hub 64 are a number of fan blades 68. Also, attached to the fan blades 68 is a circular ring 70. It is seen that the hub 64, fan blade 68 and circular ring 70 are an integral unit. Although the fan may be other design and materials, it is conceivable that a die can be prepared and that the fan 62 can be made from plastic so that the fan 62 is a unitary structure.

Figure 2:
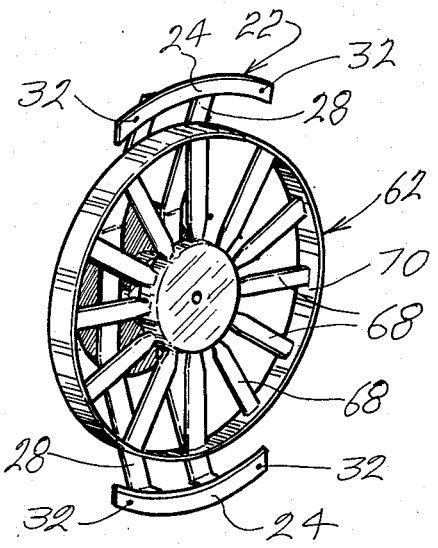
FIG. 2 is a perspective view illustrating the fan assembly in a, partially, assembled state and illustrates the fan, the mounting bracket and the electric motor.

The electric motor 40 can be mounted on the support rib 26 so that the electric motor 40 is away from the curved bases 24. Then, the fan 62 can be mounted on the rotating shaft 42 of the electric motor 40. The electric motor 40 is on one side of the support rib 26 and the fan 62 is on the other side of the support rib 26. This is illustrated in FIG. 2.

Figure 5:
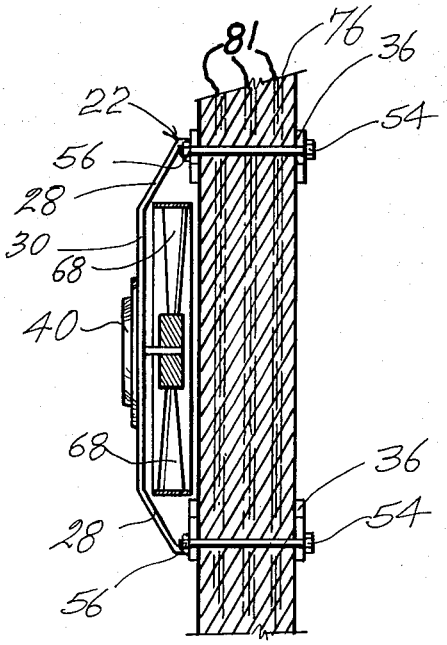
FIG. 5 is a vertical-cross-sectional view illustrating the radiator, the mounting bracket on the radiator, the electric motor and the fan.

In FIG. 5 there is illustrated the fan assembly as mounted on a radiator 76. The radiator 76 has a lower liquid reservoir tank 77 and an upper reservoir tank 79.

These two reservoir tanks are joined by tubes 81. The thickness of the wall of a tube is about 0.043 inches. It is seen that on a first side of the radiator 76 there are mounting pads 36. Also, it is seen that on the second side of the radiator 76 that there are the curved bases 24. The bolt 36 projects through the passageway 38 in the mounting pad 36 and through the passageway 32 in the curved bases 24. The bolt 54 and the nut 56 firmly attach the mounting bracket 22 and pad 36 to the radiator 76. In FIG. 5 it is seen that the motor 40 and the fan 62 are mounted on the mounting bracket 22 and in a relation to push or draw air through the radiator to cool the cooling fluid in the device.

Figure 3:
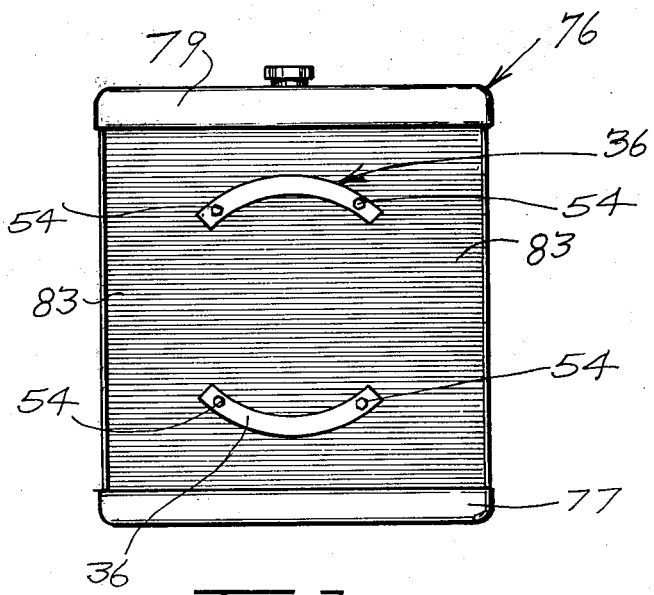
FIG. 3 is an elevational view of a radiator and illustrates the mounting pad mounted on the radiator; (Note: Multiple directional bracing through arched contact with fins)
Figure 4:
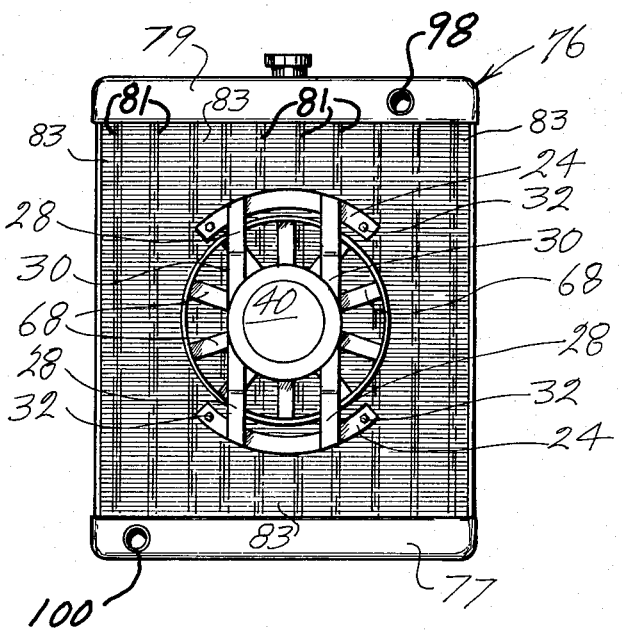
FIG. 4 is an elevational view of a combination of a radiator such as the electric motor, the fan and the mounting brackets; (Note: Fan can be mounted on either side or operate in a pusher or sucker mode. In extreme situations either mode or a combination thereof may be used to augment inadequate airflow from either a fan clutch or shaft mounted fan)

In FIG. 3 it is seen that the mounting pads 36 are on the first side of the radiator 76. And, in FIG. 4 it is seen that the mounting bracket 22, the electric motor 40 and the fan 62 are on the second side of the radiator 76. This is more clearly brought forth with reference to FIG. 5, a cross-sectional view of the radiator and which illustrates the mounting pads 36 on the first side of the radiator and the bracket 22 on the second side of the radiator.

Figure 6:
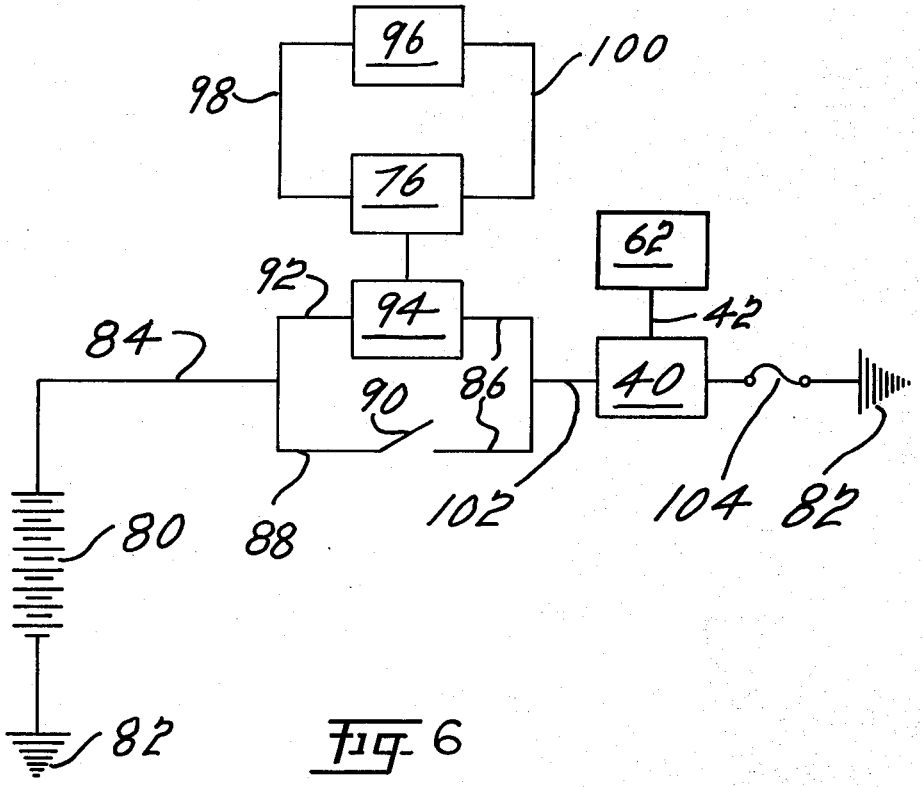
FIG. 6 is a schematic view illustrating example of a combination of the fan assembly and the radiator and the internal combustion engine.

In FIG. 6 there is a schematic illustration of the invention with electrical circuitry.

It is seen that there is a battery or other electrical power source 80 which is grounded at 82. A wire 84 runs from the electric power source 80 into a parallel circuit 86. One branch 88 of the parallel circuit has a manual switch 90. Another branch 92 of the parallel circuit has a temperature sensor and switch 94.

The temperature sensor and switch 94 is associated with the radiator 76. The radiator 76 is associated with the internal combustion engine 96. One radiator hose or tube 98 connects with the internal combustion engine for hot liquid or hot water flowing from the engine or other component to the radiator to be cooled. Another tube or hose 100 connects with the radiator and the internal combustion engine to return cooled water or cooled cooling fluid to the engine 96. This radiator application is shown to be a typical installation. The temperature sensing can be accomplished by external means without immersing the sensor into fluids or liquids.

The parallel circuit 86 connects by means of electrical line 102 to the motor 40. As, previously, stated the motor 40 has an output shaft 42 which connects with the fan 62. The fan 62 is positioned on the radiator for cooling the radiator.

The motor 40 connects with a fuse 104. The fuse 104 is grounded at 82.

The temperature sensor and switch 94 functions automatically. For example, when the automotive vehicle is moving at a speed of, approximately, less than 25 miles per hour the flow of air through the radiator is not, normally, sufficient to cool the cooling fluid in the radiator. The cooling fluid in the radiator rises to a temperature above about 180° F. The temperature sensor and switch 94 senses this temperature and closes the circuit, the parallel circuit 86, so as to cause the motor 40 to operate and the rotating shaft 42 to operate for rotating the fan 62 to cool the cooling fluid in the radiator 76.

The reader is to understand that the switch actuation temperature can be varied from 180° F.

When the automotive vehicle is traveling at a speed above, approximately, 25 miles per hour, normally, the flow of air through the radiator is sufficient to cool the cooling fluid in the radiator or the heat exchanger. The temperature sensor and switch 94 senses this temperature, below, about 180° F., and the switch 94 opens so as to have an open circuit. The motor 40 ceases to operate and the shaft 42 ceases to rotate and the fan ceases to rotate. The cooling of the cooling fluid in the radiator 76 is accomplished by air flowing through the radiator 76 and the fan 62 is not used to assist in the cooling of the cooling fluid in the radiator.

There is provided a backup manual switch 90 in case the temperature sensor and switch 94 ceases to operate. The operator of the automotive vehicle can, upon seeing that the temperature has become elevated and is above the considered safe temperature range for an internal combustion engine, throw the manual switch so as to close the circuit 86 and to activate the motor 40, rotating shaft 42 and the fan 62. Again, the fan 62 assists in the flow of air through the radiator and the cooling of the cooling fluid in the radiator 76.

It is to be clearly understood that with this fan assembly 20 mounted on the radiator that the fan, normally, mounted on the internal combustion engine and crank shaft of the internal combustion engine, may be removed. With only this one fan used for increasing the flow of air past the radiator and the cooling fluid in the radiator 76, the fan which is normally positioned on the internal combustion engine and the crank shaft of the internal combustion engine is normally removed. Two of these electric fans can be mounted together, if needed, yet may be controlled by one set of switches.

As previously stated the fan on the crank shaft of an internal combustion engine runs at both a low speed for the automotive vehicle and a high speed for the automotive vehicle.

The purpose of the fan assembly 20 is to, usually, operate only when additional cooling airflow is required, normally at low speeds of the automotive vehicle, viz., less than 25 miles per hour. To repeat, at higher speeds of the automotive vehicle the flow of air through the radiator, normally, is sufficient to cool the cooling fluid in the radiator. Therefore, it is not necessary to have a fan for cooling purposes or for assisting the flow of air through the radiator to cool the cooling fluid. The operation of the fan at higher automotive speeds is a waste of energy. With the unique mounting of this invention it is possible to terminate the operation of the motor 40 at the higher automotive speeds. Therefore, there is a saving in energy and a saving in fuel for powering the internal combustion engine. As an example, it is estimated that in urban driving there is a fifteen (15%) percent improvement in fuel economy or there is less fuel used to propel the automotive vehicle. And, at a higher speed, viz., above 25 miles per hour, there is a corresponding decrease in fuel consumption and a corresponding increase in fuel economy.

In FIG. 7 there is illustrated a heat exchanger or a radiator 110.

This heat exchanger 110 has vertical reservoirs 112 and 114 joined by tubes 116. In FIG. 7 it is seen that the heat exchanger 110 is long or wide. This means that the tubes 116 are long. The long tubes 116 tend to rupture and the wells between the tubes 116 and reservoirs 112 and 114 tend to break. One of the causes of the malfunctioning of the tubes 116 is the vibration due to the automotive vehicle moving. Another cause of the malfunction is the expansion and contraction with heating and cooling of the liquid in the radiator. To decrease the malfunctioning of the radiator and the tubes in the radiator there is used a vertical brace or center brace 118.

I have noticed that the use of the fan assembly 20 with the heat exchanger 110 or radiator 110 that there is less malfunctioning of the radiator and tubes 116. The mounting bracket 22 and the mounting pad 36 add rigitity to the radiator 110 and brace the tubes 116. The bases 24 in the arcuate configuration add stability and brace the tubes 116. The net result is that the heat exchanger 110 has less malfunction when used with the fan assembly 20 because of the bracing effect and added stability. In addition to the center brace 118 on the heat exchanger 110 there are two spaced apart bases 24 and mounting pads 36 which stiffen the radiator. In FIG. 7 there is illustrated two fan assemblies 20 on the heat exchanger 110.

In FIG. 8 there is a schematic illustration of an automotive vehicle. In this schematic illustration there is illustrated a number of heat exchange units.

The schematic illustration of the automotive vehicle 120 shows an internal combustion engine 122. There is an automatic transmission 124 which connects with the engine 122 by means of the crankshaft 126. There is a differential 128 which connects with the automatic transmission 124 by means of a drive line 130.

There is a heat exchanger unit 132 or radiator 132 which connects with the internal combustion engine 122 by means of tubes or lines 134 and 136.

In certain instances the lubricating fluid in the differential 128 is cooled. For example, an automotive vehicle used for racing purposes and also in some heavy duty trucks the fluid in the differential is cooled. With my invention there can be associated with the differential 128 a heat exchanger unit 138. The heat exchanger unit 138 connects the differential 128 by means of tubes or lines 140 and 142. There can be mounted on the heat exchanger unit 138 or associated with the radiator 138 the fan assembly 20. The fan assembly 20 makes it possible to mount the heat exchanger unit 138 close to the differential 128 and lessen the length of the tubes or lines 140. Also, the cooling of the lubricant in the differential 128 is not dependent upon the ram effect of air on the heat exchanger 138 as the fan assembly 20 can function to cool the lubricant in the differential 128 when the automotive vehicle 120 moves slowly.

In FIG. 8 there is illustrated, in phantom, a heat exchanger 144 or a radiator 144 associated with the automatic transmission 124. The lubricating fluid in the automatic transmission 124 is cooled. The heat exchanger unit 144 is positioned in front of or in back of the radiator 132 or heat exchanger 132. There are long tubes or lines 146 and 148 connecting the automatic transmission 124 with the heat exchanger 144. It is seen that the heat exchangers 144 and 132 are in a stacked relationship so that the hot air from one of these heat exchangers is introduced as hot air to the other heat exchanger. This is the conventional manner for positioning the heat exchangers associated with the automatic transmission and with the internal combustion engine.

With my invention it is not necessary to stack the heat exchangers associated with the automatic transmission and internal combustion engine as there can be used a heat exchanger 150, in close proximately to the automatic transmission 124. There can be associated with the heat exchanger 150 the fan assembly 20. Then, there can be tubes or lines 152 and 154 connecting the automatic transmission 124 and the heat exchanger 150. Again, with the fan assembly 20 it is possible to have the heat exchanger for cooling the lubricant in the automatic transmission 124 near the automatic transmission 124 and not in a stacked relationship to the heat exchanger for cooling the internal combustion engine. One of the advantages of using the fan assembly 20 with the heat exchanger 154 is that the tubes between the automatic transmission 124 and heat exchanger 150 are of, relatively, short length and another advantage is that it is not necessary to have heat exchangers in a stacked relationship so that the hot air from one heat exchanger flows to a following heat exchanger. A further advantage is that is is not necessary to depend upon the ram effect of air passing over the heat exchanger 150 as the fan assembly 20 assures a continuous flow of air to the heat exchanger 150 for a cooling the fluid in the heat exchanger 150.

In FIG. 8 there is illustrated an air conditioner 156. It is seen that the crankshaft 126 in the internal combustion engine 122 connects by means of a belt 160 with the pully 158 on the air conditioner 156. A conventional way of cooling the fluid in the air conditioner 156 was to place a heat exchanger 162 close to the heat exchanger 132 for the internal combustion engine 122. There were two tubes or lines 164 and 166 connecting the air conditioner 156 with the heat exchanger 162. Again, there was a stacked relationship between the heat exchanger 162 and the heat exchanger 132. In certain instances, there would be a stacked relationship between the heat exchanger 132 associated with the internal combustion engine 122; the heat exchanger 144 associated with the automatic transmission 124; and, the heat exchanger 162 connected with the air conditioner 156. In other words, the hot exhaust air passing from the first heat exchanger would be introduced to the second heat exchanger and the hot exhaust air from the second heat exchanger would be introduced to the third heat exchanger. One of these results would be a larger second heat exchanger than would be required if there were not a stacked relationship and also a larger third heat exchanger provided there were not a stacked relationship. With my invention it is possible to place the heat exchanger 166 close to the air conditioner 156. Then, a fan assembly 20 is placed near the heat exchanger 168. The air conditioner 156 connects with the heat exchanger 168 by means of tubes or lines 170 and 172. With the heat exchanger 166 near the air conditioner 156 it is not necessary to have long tubes or lines 170 and 172. Also, with the fan assembly 20 associated with the heat exchanger 168 it is not necessary to depend upon the ram effect air passing over the heat exchanger 168. Again, one of the main advantages to using the fan assembly 20 with the heat exchanger 168 is that it is not necessary to have long tubes or lines 170 and 172 but short tubes like 170 and 172 can be used and also the heat exchanger 168 can be placed close to the air conditioner 156.

From the foregoing it is seen that this fan assembly results in a saving in fuel or less fuel is required to propel the automotive vehicle as compared with an automotive vehicle having an internal combustion engine and a fan mounted on the crank shaft or water pump of the internal combustion engine and which fan turns or rotates when the engine is running and operating. With this fan assembly it is possible, when it is not necessary to have the fan rotate, to stop the rotation of the fan and thereby save fuel. One of the side effects of this fan assembly is that the fan is not always rotating, as at higher speeds it is not normally necessary to have an auxiliary means for the flow of air past the heat exchanger unit or radiator, and therefore with the fan not rotating there is less noise. The reduction in noise is desirable. In addition, this fan assembly can be mounted on existing automotive vehicles having an internal combustion engine and a heat exchange unit or radiator. For example, the fan can be removed from the crank shaft, water pump or the output shaft of the internal combustion engine. Then, the fan assembly can be mounted on the radiator. The temperature sensor and switch 94 can be associated with the radiator. One place for the temperature sensor and switch 94 to be associated with the radiator is in the intake opening to the radiator and which intake opening connects with the engine so as to receive hot cooling fluid from the engine. In this configuration the temperature sensor and switch 94 monitors the temperature of the cooling fluid from the engine and if the cooling fluid from the engine is of a sufficiently low temperature it is not necessary for the fan 62 to rotate. Another place the temperature sensor and switch 94 can be mounted is in the outlet tube or hose from the radiator and which outlet tube or hose connects with the engine and for conveying cooled cooling fluid from the radiator to the engine. If the temperature of the cooling fluid flowing from the radiator to the internal combustion engine is of a sufficiently low temperature then the temperature sensor and switch 94 will be open and the circuit 86 will be open and the motor 40 will not operate. Conversely, if the temperature of the cooling fluid is of a sufficiently high temperature then the temperature sensor and switch 94 will be closed and the motor 40 will operate and the fan 62 will rotate. Temperature sensing and actuations for the multiple operations or possible uses are infinite.

The fan assembly 20 may be considered to be a reinforcement for the tubes in the radiator. For example, the mounting bracket 22 may be considered to be a supporting bracket 22. There is arcuate base 24. From the foregoing description, it is seen that there are two spaced apart arcuate bases 24. There connects the two spaced apart bases 24 braces comprising the angular pieces 28 and a flat piece 30. There are two of these braces. There is a cross member, viz., the electric motor 40, connecting the two braces to add rigidity to the two braces, and, thereby, add rigidity to the two arcuate bases. Then, there is a mounting pad 36 or a mounting means 36. Nuts and bolts connect the spaced apart bases 24 and the mounting means 36 so as to firmly and rigidly attach the bases and the mounting means to the fins 83 and thereby the tube 81. The placing of the arcuate mounting bases and the mounting means onto the fins 83 tends to brace and support these tubes and to decrease the effect of the temperature differential at the bottom of the tube as compared with the top of the tube, i.e., the temperature at the top of the tube is greater than the temperature at the bottom of the tube, and also tends to lessen the vibration of the tubes and the mechanical twisting of the tubes with the movement of the truck. The net affect is that the bracing of the fins and the tubes on the radiator lessens the possibility of the seals between the tubes and the reservoirs breaking and therefore lengthens the life of the radiator and decreases the cost of repair of the radiator, due to normal wear and tear the radiator lasts longer with the fan assembly 20 in position as compared to a radiator not having the benefit of the fan assembly 20 or, as may be considered, the fan assembly being a supporting means and reinforcing means for the tubes and fins of the radiator.

I consider this invention to be new as it is possible to retrofit an existing automotive vehicle and to place this fan assembly on the radiator to increase the flow of air through the radiator and the cooling fluid when required. Also, I consider this invention to be useful as it does decrease the amount of fuel required to operate the internal combustion engine of the automotive vehicle as the fan is not always rotating, especially, at the higher speeds. With the fan not rotating at the higher speeds it is not necessary for the internal combustion engine to use as much energy and as much fuel.

A patent search was not made prior to the preparation of this patent application.

From the foregoing and having presented my invention, what I claim is:

1. A fan assembly comprising:

a. a motor having a rotating shaft;

b. a fan having a first means for attaching said fan to said shaft;

c. a second means for mounting said motor and said fan on a heat exchanger;

d. said heat exchanger comprising a combination of tubes and fins, operatively, connecting with each other;

e. said second means, operatively, connecting with and mounted on said combination of tubes and fins so that the combination supports said second means;

f. a third means in response to temperature for controlling the operation of the motor and the rotating shaft and the fan;

g. said second means comprising a mounting bracket;

h. a means for securing said mounting bracket to the combination of tubes and fins of said heat exchanger associated with a source of fluid;

i. a means for allowing fluid to flow between said heat exchanger and said source of fluid;

j. said motor being an electric motor;

k. said third means, in response to the temperature of said fluid, controlling the operation of said motor sand fan;

l. said motor connecting with a source of electricity;

m. said mounting bracket comprising an integral support unit and mounting pads;

n. said integral support unit comprising two spaced apart bases;

o. said two spaced apart bases and said mounting pads co-fitting with each other with said integral support unit on one side of said heat exchanger and said mounting pads on the other side of said heat exchanger;

p. means connecting said bases and said mounting pads to attach said mounting bracket to said radiator; and q. means for attaching and mounting said motor on said integral support unit.

2. A combination of a heat exchanger and a fan assembly:

a. said fan assembly comprising a motor having a rotating shaft;

b. a fan having a first means for attaching said fan to said shaft;

c. a second means for connecting said fan assembly with said heat exchanger and for supporting said motor and said fan on said shaft;

d. said heat exchanger comprising a combination of tubes and fins, operatively, connecting with each other;

e. said second means, operatively connecting with and mounted on said combination of tubes and fins so that the combination supports said second means;

f. a third means in response to temperature for controlling the operation of the motor and the rotating shaft and the fan;

g. said second means comprising a mounting bracket;

h. a means for securing said mounting bracket to the combination of tubes and fins of said heat exchanger associated with a source of fluid;

i. a means for allowing fluid to flow between said heat exchanger and said source of fluid for the purpose to change the temperature of said fluid;

j. said motor being an electric motor;

k. said third means, in response to the temperature of said fluid controlling the operation of said motor and said fan;

l. said motor connecting with a source of electricity;

m. said motor connecting with a source of electricity;

n. said mounting bracket comprising an integral support unit and mounting pads;

o. said integral support unit comprising two spaced apart bases and a support rib connecting said two spaced apart bases;

p. said two spaced apart bases and said mounting pads co-fitting with each other and with said integral support unit on one side of the combination of tubes and fins of said heat exchanger and said mounting pads on the other side of the combination of tubes and fins of said heat exchanger;

q. means connecting said bases and said mounting pads to attach each mounting bracket to said heat exchanger;

r. said means connecting said bases and said adjacent to said combinations of tubes and fins; and s. means for attaching and mounting said motor on said integral support unit.

3. A fan assembly according to claims 1 or 2, and comprising:

a. said source of fluid being an automatic transmission in an automotive vehicle.

4. A fan assembly according to claims 1 or 2, and comprising:

a. said source of fluid being an air conditioner in an automotive vehicle.

5. A fan assembly according to claims 1 or 2, and comprising:

a. said source of fluid being a differential in an automotive vehicle.

6. A fan assembly according to claims 1 or 2, and comprising:

a. said source of fluid being an internal combustion engine in an automotive vehicle.

* * * * *